United States Patent [19]

Tanahashi

[11] 4,189,670

[45] Feb. 19, 1980

[54] POWER CIRCUIT FOR DIFFERENT STABILIZED DC VOLTAGES

[75] Inventor: Makoto Tanahashi, Yokohama, Japan

[73] Assignee: Sony Corporation, Tokyo, Japan

[21] Appl. No.: 915,264

[22] Filed: Jun. 13, 1978

[30] Foreign Application Priority Data

Jun. 18, 1977 [JP] Japan ..... 52-79937[U]

[51] Int. Cl.[2] ..... G05F 1/58

[52] U.S. Cl. ..... 323/9; 307/34; 323/25

[58] Field of Search ..... 307/31–35; 323/9, 22 T, 23, 25; 361/18

[56] References Cited

U.S. PATENT DOCUMENTS

| | | | |
|---|---|---|---|
| 2,780,734 | 2/1957 | Gamble | 323/23 X |
| 3,571,604 | 3/1971 | La Porta et al. | 323/23 X |
| 3,671,852 | 6/1972 | Ritzenthaler | 323/9 |
| 3,983,473 | 9/1976 | Sanderson | 323/25 X |

FOREIGN PATENT DOCUMENTS

| | | | |
|---|---|---|---|
| 2104701 | 4/1972 | France | 307/31 |

OTHER PUBLICATIONS

Eckhardt, "Regulator For OP Amps Practically Powers Itself", Electronics, Oct. 3, 1974, p. 106.

Feebeck et al., "Dual—Voltage, Opposite Tracking Regulator", IBM Tech. Disc. Bull. vol. 14, No. 9, Feb. 1972, p. 2636.

Adamian, "Dual Adjustable Tracking Regulator Delivers 0.5A/Side", Edn. Jan. 5, 1977, p. 42.

*Primary Examiner*—A. D. Pellinen

*Attorney, Agent, or Firm*—Lewis H. Eslinger; Alvin Sinderbrand

[57] ABSTRACT

In a power circuit arrangement, there are a plurality of voltage stabilizers each including a reference voltage source, a circuit for comparing the output of the respective voltage stabilizer with a reference voltage, and a voltage control element responsive to the output of the comparing circuit. The reference voltage for at least one of the voltage stabilizers is provided by an independent element, and the reference voltage for the remaining voltage stabilizers is formed on the basis of the output voltage of the other voltage stabilizers. When the output voltage of any one of the voltage stabilizers becomes zero, all of the other voltage stabilizers similarly have their output voltages reduced to zero.

10 Claims, 2 Drawing Figures

POWER CIRCUIT FOR DIFFERENT STABILIZED DC VOLTAGES

BACKGROUND OF THE INVENTION

1. Field of the Invention

This invention relates to a power circuit for providing at least two different stabilized DC voltages, and more particularly to a power circuit, as aforesaid, which is most suitable for inclusion in an electronic apparatus.

2. Description of the Prior Art

Generally, in an electronic apparatus requiring a plurality of different DC voltages, for example, as in a micro-computer which requires DC voltages of +12 volts, +5 volts and −5 volts, there is the danger that some circuit elements of the apparatus may be reversely biased to such an extent as to be broken or damaged when any one of the plural different DC voltages fails. In a conventional apparatus to prevent such damage, there are provided means for detecting when any one of the DC voltages becomes zero or is lower than a predetermined level, and means for cutting off all the other DC voltages in response to the detection of a severe drop in any one voltage. However, the described conventional apparatus require special complicated circuits and, therefore, entail undesirably high costs.

OBJECTS AND SUMMARY OF THE INVENTION

Accordingly, it is generally an object of this invention to provide a power circuit for providing a plurality of different stabilized DC voltages and which overcomes the above-described disadvantages of the prior art.

Another object of this invention is to provide a power circuit for providing a plurality of different stabilized DC voltages by means of respective voltage stabilizers, and in which, when any one of the output voltages of the voltage stabilizers becomes zero, all of the other output voltages also become zero, whereby damage to circuit elements of an electronic apparatus using the different output voltages can be prevented.

In accordance with an aspect of this invention, a power circuit for providing different stabilized DC voltages includes a first voltage stabilizer having a reference voltage source, an output-voltage detecting element and a voltage control element, the voltage control element being controlled with the output of the output-voltage detecting element on the basis of a comparison between the output voltage of the first voltage stabilizer and the voltage of the reference voltage source; at least a second voltage stabilizer including circuit means for forming a reference voltage from the output voltage of the first voltage stabilizer, a second output-voltage detecting element and a second voltage control element; and connecting means for biasing the reference voltage source of the first voltage stabilizer by the output voltage of the second voltage stabilizer, whereby, when the output voltage of any one of the voltage stabilizers becomes zero, the output voltages of the other voltage stabilizers also become zero.

The above, and other objects, features and advantages of this invention, will be apparent in the following detailed description of illustrative embodiments which is to be read in connection with the accompanying drawings.

DESCRIPTION OF THE PREFERRED EMBODIMENTS

Figure 1:
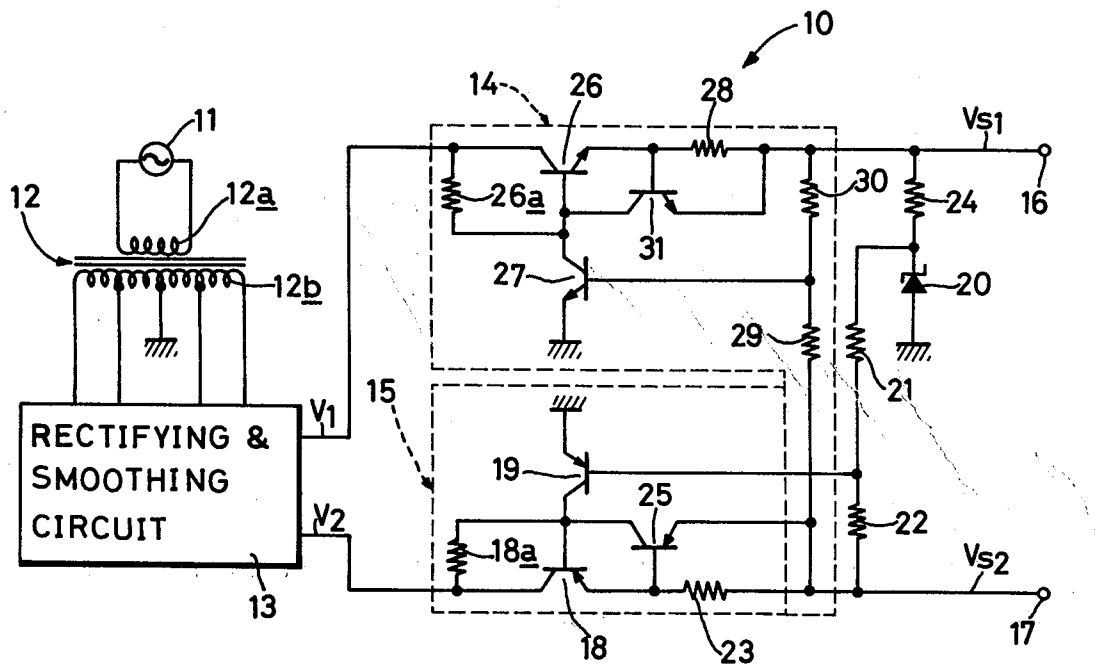
FIG. 1 is a schematic circuit diagram of a power circuit according to one embodiment of this invention and in which two stabilized voltages are provided.

Referring to the drawings in detail, and initially to FIG. 1 thereof, it will be seen that, in a power circuit 10 according to one embodiment of this invention, a commercial AC power supply 11 is connected to a primary winding 12*a* of a power transformer 12. Plural dropped voltages are obtained from a secondary winding 12*b* of the transformer 12, and are supplied to a rectifying/smoothing circuit 13 from which rectified and smoothed DC voltages $V_1$ and $V_2$ are obtained. The DC voltages $V_1$ and $V_2$ are supplied to voltage stabilizers 14 and 15, respectively. Stabilized DC voltages $Vs_1$ and $Vs_2$, for example, of +12 volts and −5 volts, respectively, are obtained from output terminals 16 and 17.

The output voltage $V_2$ of rectifying/smoothing circuit 13 is supplied to the collector of a voltage control transistor 18 and through a resistor 18*a* to the base of such transistor in voltage stabilizer 15. The collector of a transistor 19 for detecting output voltage is connected to the base of transistor 18. The cathode of a Zener diode 20 for supplying a reference voltage is connected through a resistor 21 to the base of transistor 19 and further through resistor 21 and resistors 22 and 23 to the emitter of transistor 18.

The output voltage $V_{S1}$ of voltage stabilizer 14 is supplied, as a bias voltage, through a resistor 24 to Zener diode 20. The emitter of transistor 19 is connected directly to ground.

The following relationship holds good in the above circuit arrangement:

$$V_{S2}=(R_{22}/R_{21})\cdot V_R \quad (1)$$

in which $V_R$ represents the reference voltage from Zener diode 20, $V_{S2}$ is the stabilized output voltage of voltage stabilizer 15, $R_{21}$ is the resistance of resistor 21, $R_{22}$ is the resistance of resistor 22, and the base-emitter voltage of transistor 19 is neglected. If, for example, the output voltage $V_{S2}$ is decreased with an increase in the load current flowing from output terminal 17, the potential at the connection between resistors 21 and 22 is positively raised to decrease the collector potential of transistor 19 and, thus, the collector-emitter voltage of transistor 18 is lowered. Therefore, the output voltage $V_{S2}$ is compensated for the decrease thereof and, as the result, voltage $V_{S2}$ is always maintained constant.

The resistor 23 having a low resistance and connected between the emitter of transistor 18 and output terminal 17 and a transistor 25 constitute an overcurrent protecting circuit. When the load current flowing through output terminal 17 is greater than a rated current, the voltage across the detecting resistor 23 becomes higher than the base-emitter voltage $V_{BE}$, and so transistor 25 becomes conductive. As a result, the base potential of transistor 18 becomes nearly equal to the potential $V_{S2}$ at output terminal 17 and, thus, transistor 18 becomes non-conductive. Therefore, the overcurrent can be prevented.

In voltage stabilizer 14, the output voltage $V_1$ from rectifying/smoothing circuit 13 is supplied to the collector of a voltage control transistor 26 and through a resistor 26*a* to the base of such transistor. The base of transistor 26 is connected to the collector of a transistor 27 for detecting an output voltage, and the emitter of transistor 26 is connected through a resistor 28 to the output terminal 16. The emitter of transistor 27 is connected directly to the ground, and the base of transistor 27 is connected through a resistor 29 to output terminal 17 of voltage stabilizer 15 and further connected through a resistor 30 and resistor 28 to the emitter of transistor 26.

The following relationship holds good in the above circuit arrangement:

$$V_{S1}=(R_{30}/R_{29})V_{S2} \quad (2)$$

in which $V_{S2}$ represents the stabilized output voltage of voltage stabilizer 15, $V_{S1}$ is the stabilized output voltage of voltage stabilizer 14, $R_{29}$ is the resistance of resistor 29 and $R_{30}$ is the resistance of resistor 30, with the base-emitter voltage of transistor 27 being neglected. If, for example, the output voltage $V_{S1}$ is decreased with an increase of the load current flowing from output terminal 16, the potential at the connection of resistors 29 and 30 is lowered to decrease the collector current of transistor 27 and, therefore, the base voltage of transistor 26 is raised to decrease the collector-emitter voltage of transistor 26. Thus, the output voltage $V_{S1}$ is compensated for the decrease thereof, and, as a result, the output voltage $V_{S1}$ is always maintained constant. The output voltage $V_{S2}$ of voltage stabilizer 15 is supplied as a reference voltage through resistor 29 to the base of transistor 27.

The resistor 28 having a low resistance and connected between the emitter of transistor 26 and output terminal 16, and a transistor 31 constitute an overcurrent protecting circuit, in a manner similar to that described above in respect to transistor 25 in voltage stabilizer 15.

In the above described circuit arrangements, when one of the two voltage stabilizers 14 and 15, for example, the stabilizer 14, operates so defectively that the output voltage $V_{S1}$ becomes zero, the bias voltage to Zener-diode 20 also becomes zero. Thus, the base potential of transistor 19 becomes negative to put transistor 19 in its conductive state. A positive voltage is supplied as a bias voltage to the base of transistor 18 to put the latter into its non-conductive state. As a result of the foregoing, no voltage is generated at output terminal 17.

On the other hand, if the defect occurs in voltage stabilizer 15 so that output voltage $V_{S2}$ becomes zero, the bias voltage from resistor 29 becomes zero, and only the positive bias voltage is supplied to the base of transistor 27 from the resistor 30. Thus, transistor 27 becomes perfectly or strongly conductive. As a result, the potential at the base of transistor 26 becomes equal to that of the ground, to put transistor 26 into the non-conductive state. Thus, no voltage is generated at output terminal 16.

Figure 2:
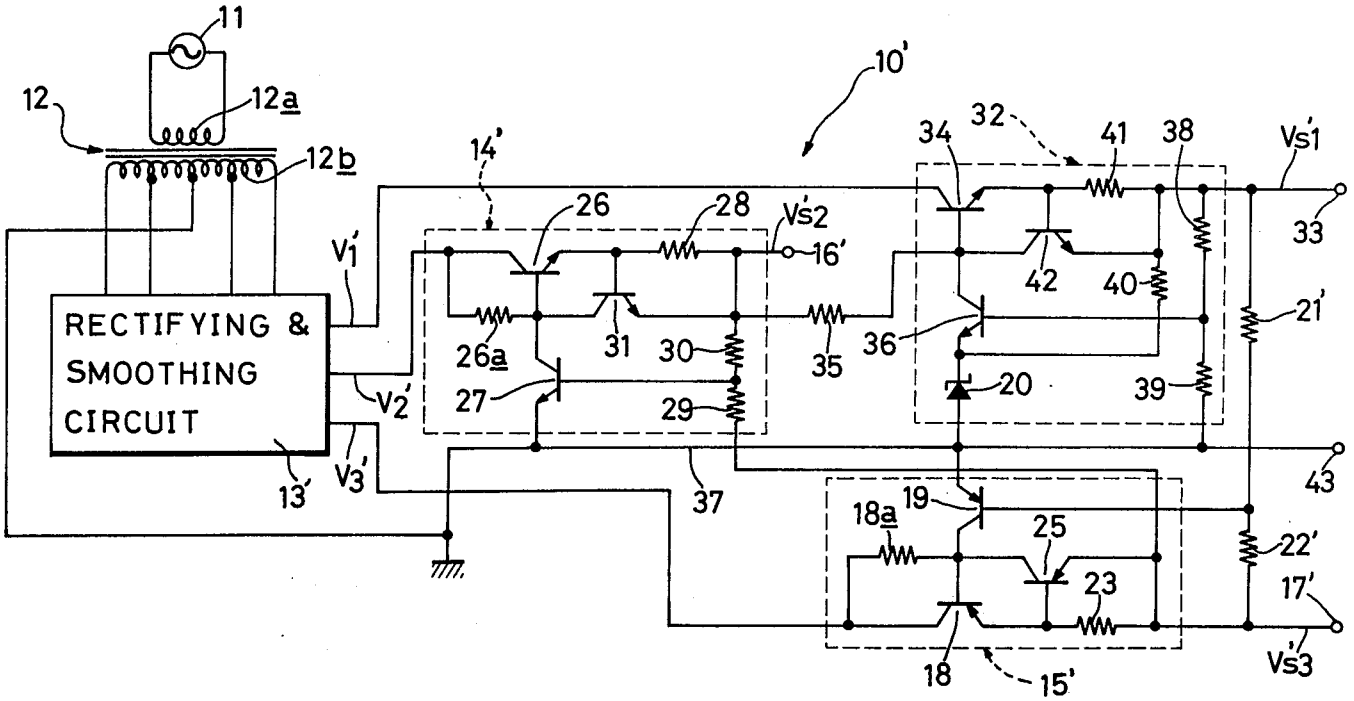
FIG. 2 is a schematic circuit diagram of a power circuit according to another embodiment of this invention in which three stabilized voltages are provided.

Referring now to FIG. 2, it will be seen that the power circuit 10' according to another embodiment of this invention is there shown to be provided with three voltage stabilizers, in contrast to the two voltage stabilizers 14 and 15 of the first described embodiment. Parts of the power circuit shown in FIG. 2 which correspond to those described above with reference to FIG. 1, are denoted by the same reference numerals. In FIG. 2, a commercial AC power supply 11 is again connected to a primary winding 12*a* of a power transformer 12. Plural dropped voltages are obtained from a secondary winding 12*b* of transformer 12, and supplied to a rectifying/smoothing circuit 13' which provides rectified and smoothed DC voltages $V'_1$, $V'_2$ and $V'_3$. The DC voltages $V'_1$, $V'_2$ and $V'_3$ are supplied to voltage stabilizers 32, 14' and 15', respectively. Stabilized DC voltages $V'_{S1}$, $V'_{S2}$ and $V'_{S3}$, for example, of +12 volts, +5 volts and −5 volts, respectively, are obtained from output terminals 33, 16' and 17'.

The output voltage $V'_1$ of the rectifying/smoothing circuit 13 is supplied to the collector of a voltage control transistor 34 in voltage stabilizer 32. A base current is supplied through a resistor 35 to the base of transistor 34 from the output of voltage stabilizer 14'. Further, the base of transistor 34 is connected to the collector of a transistor 36 for detecting output voltage. The cathode of a Zener diode 20 for supplying a reference voltage $V_Z$ is connected to the emitter of transistor 36, and the anode of Zener diode 20 is connected to ground through a line 37. The base voltage of transistor 36 is the voltage at the connection between resistors 38 and 39 which are connected in series between output 33 and ground line 37, and such base voltage is always maintained at $V_Z+V_{BE}$, where $V_{BE}$ represents the base-emitter voltage of transistor 36. As a result, the output voltage $V'_{S1}$ obtained from output terminal 33 of voltage stabilizer 32 is always maintained at the value $$\frac{R_{38}+R_{39}}{R_{38}}(V_Z+V_{BE})=V'_{S1} \quad (3)$$

in which $R_{38}$ and $R_{39}$ are the resistance values of resistors 38 and 39.

If, for example, the output voltage $V'_{S1}$ is reduced with an increase of the load current flowing from output terminal 33, the potential at the connection of resistors 38 and 39 is lowered to decrease the collector current of transistor 36. Accordingly, the base voltage of transistor 34 is raised, and the collector-emitter voltage thereof is decreased. Thus, the output voltage $V'_{S1}$ is compensated for the decrease, and, as a result, the output voltage is always maintained constant, for example, at +5 volts.

The output voltage $V'_{S1}$ is supplied as a bias voltage through a resistor 40 to Zener diode 20. A resistor 41 having a low resistance value is connected between the emitter of transistor 34 and output terminal 33 and, together with a transistor 42, constitutes an overcurrent protecting circuit. When the load current flowing from output terminal 33 is greater than a rated current, the voltage across detecting resistor 41 becomes higher than the base-emitter voltage $V_{BE}$ and, therefore, transistor 42 becomes conductive. As a result, the base potential of transistor 34 becomes nearly equal to the potential $V'_{S1}$ of the output terminal 33 and, therefore, transistor 34 becomes non-conductive. Thus, overcurrent can be prevented.

The output voltage $V'_{S1}$ of voltage stabilizer 32 is dropped to a predetermined voltage by a voltage divider consisting of resistors 21' and 22'. The resulting dropped voltage is supplied, as a reference voltage, to the base of transistor 19 for detecting output voltage in voltage stabilizer 15'. The base current of voltage control transistor 18 is controlled with the collector current of the transistor 19. Thus, the stabilized output voltage $V'_{S3}$ is obtained from output terminal 17' and it is lower than the voltage (ground potential) at a terminal 43 connected to line 37, for example, voltage $V'_{S3}$ may be −5 volts. The base current of transistor 18 is regulated by resistor 18*a*. Resistor 23 and transistor 25 constitute an overcurrent protecting circuit, as previously described.

The output voltage $V'_{S3}$ of voltage stabilizer 15' is divided into a predetermined voltage by resistors 29 and 30. The divided voltage is supplied as a reference voltage to the base of transistor 27 for detecting the output voltage in the voltage stabilizer 14'. The base current of voltage control transistor 26 is controlled with the collector current of transistor 27. Thus, the stabilized output voltage $V'_{S2}$, for example, of +12 volts, is obtained from output terminal 16'. The base current of transistor 26 is regulated by a resistor 26*a* and, in the same manner as in the other voltage stabilizers, resistor 28 and transistors 31 constitute an overcurrent protecting circuit.

As already described, the output voltage $V'_{S2}$ of voltage stabilizer 14' is supplied through resistor 35 to the base of voltage control transistor 34 in voltage stabilizer 32 to provide the base current flow of transistor 34. When the output voltage $V'_{S2}$ of voltage stabilizer 14' is designed to be higher than the output voltage $V'_{S1}$ of voltage stabilizer 32, the base current can be determined so that power transistor 34 is almost saturated when the output current of voltage stabilizer 32 is nearly equal to the rated current. For example, when the output voltage $V'_{S1}$ of voltage stabilizer 32 is +5 volts, and the collector-emitter voltage $V_{CES}$ of transistor 34 is 0.1 volts when transistor 34 is saturated, the output voltage $V'_1$ of rectifying/smoothing circuit 13' may be about 5.1 volts. Thus, the secondary voltage of transformer 12 for forming the voltage $V'_{S1}$ can be lower.

In the circuit arrangement described above with reference to FIG. 2, when any one or more of the three voltage stabilizers 32, 14' and 15' operates defectively so that the corresponding output voltage becomes zero, for example, when the output voltage $V'_{S1}$ of voltage stabilizer 32 falls to zero, transistor 19 is changed-over to its non-conductive state and, as a result thereof, voltage control transistor 18 is changed-over to its non-conductive state. Accordingly, the output voltage $V'_{S3}$ becomes zero. Further, the output voltage $V'_{S2}$ of voltage stabilizer 14' which is operated on the basis of the output voltage $V'_{S3}$ becomes the same potential as the latter, namely zero.

Similarly, when the voltage stabilizer 14' or 15' operates so defectively that the corresponding output voltage becomes zero, the output voltages of the other voltage stabilizers also become zero. For example, when the output voltage $V'_{S3}$ of voltage stabilizer 15' becomes zero, the output voltage $V'_{S2}$ of the voltage stabilizer 14' also becomes zero as above described. As a result of the foregoing, the base current no longer flows through resistor 35 to the base of transistor 34 and the latter is changed-over to its non-conductive state to cause output voltage $V'_{S1}$ to become zero.

Although the above described power circuits according to the invention include two and three voltage stabilizers, respectively, it will be apparent that the invention may be applied to power circuits which include four or more voltage stabilizers.

Generally, in power circuits according to this invention, the reference voltage for one voltage stabilizer is formed on the basis of the output voltage of another voltage stabilizer having an independent reference voltage source, and a bias current responsive to the output voltage of said one voltage stabilizer is supplied to a voltage control element of the other voltage stabilizer. Accordingly, when any one of the output voltages of the voltage stabilizers becomes zero, the output voltages of the other voltage stabilizers also similarly become zero, without requiring a special or complicated circuit therefor. The use of power circuits embodying this invention in electronic apparatus ensures that circuit elements of such apparatus will not be damaged in the event that any one or more of the output voltages of the power circuit is seriously disrupted.

Although illustrative embodiments of the invention have been described in detail herein with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A power circuit for providing a plurality of different stabilized DC voltages comprising:

a plurality of voltage stabilizing circuits each adapted to provide a respective one of said different stabilized DC voltages;

each of said voltages stabilizing circuits including a voltage control element for regulating a respective output voltage forming said respective stabilized DC voltage, means forming a respective reference voltage, and an output voltage level detecting element for detecting a difference between said respective output voltage and reference voltage and providing a corresponding control signal to said voltage control element;

said means forming the respective reference voltage in one of said voltage stabilizing circuits being responsive to said output voltage in another of said voltage stabilizing circuits; and connecting means responsive to said output voltage in said one voltage stabilizing circuit for varying the effect, in another of said voltage stabilizing circuits, of the respective control signal on the respective voltage control element so that said output voltage of each of said voltage stabilizing circuits becomes zero whenever the output voltage of any other one of said voltage stabilizing circuits becomes zero.

2. A power circuit according to claim 1; in which each of said voltage stabilizing circuits further includes overload protecting means.

3. A power circuit according to claim 2; in which said voltage control element of each of said voltage stabilizing circuits includes a transistor which is normally in a conductive state to provide the respective output voltage through an output circuit; and said overload protecting means includes means in said output circuit to detect an overload thereon, and means to change-over the respective transistor to a non-conductive state when an overload is detected in said output circuit.

4. A power circuit according to claim 1; in which there are first and second of said voltage stabilizing circuits, said first voltage stabilizing circuit has said means for forming the respective reference voltage in dependence on said output voltage of said second voltage stabilizing circuit, and said connecting means includes biasing means for biasing said means forming the reference voltage of said second voltage stabilizing circuit by said output voltage of the first voltage stabilizing circuit.

5. A power circuit according to claim 4; in which said means forming the reference voltage of said second voltage biasing circuit includes a Zener diode, and said biasing means includes resistance means through which a bias voltage dependent on said output voltage of said first voltage stabilizing circuit is applied to said diode.

6. A power circuit according to claim 1; in which said voltage control element of each of said voltage stabilizing circuits is constituted by a first transistor having an output circuit and a control electrode for varying the conductivity of said output circit in dependence on a potential applied to said control electrode; said output voltage detecting element of each of the voltage stabilizing circuits includes a second transistor having an output circuit for determining said potential applied to the control electrode of the respective first transistor in dependence on a potential applied to a control electrode of said second transistor; said means forming the respective reference voltage in said one voltage stabilizing circuit includes voltage divider means connected between the output circuits of the first transistors in said one and said other voltage stabilizing circuits and having a voltage dividing connection to said control electrode of said second transistor in said one voltage detecting circuit; said means forming the respective reference voltage in said other voltage stabilizing circuit includes a Zener diode and means for applying a reference voltage established by said diode to said control electrode of said second transistor in said other voltage stabilizing circuit; and said connecting means applies to said Zener diode a bias voltage dependent on the output voltage of said one voltage stabilizing circuit.

7. A power circuit according to claim 6; in which each of said voltage stabilizing circuits further includes a third transistor for detecting an excessive current in said output circuit of the respective first transistor, said third transistor being connected with said control electrode of the respective first transistor to render the latter non-conductive in response to a detected excessive current.

8. A power circuit according to claim 1; in which there are first, second and third of said voltage stabilizing circuits, said first voltage stabilizing circuit has said means for forming the respective reference voltage in dependence on said output voltage of said second voltage stabilizing circuit, said second voltage stabilizing circuit has its means for forming the respective reference voltage dependent on said output voltage of said third voltage stabilizing circuit, and said connecting means applies to said voltage control element of the third voltage stabilizing circuit a biasing current dependent on the output voltage of said first voltage stabilizing circuit.

9. A power circuit according to claim 8; in which said voltage control element of each of said voltage stabilizing circuits is constituted by a first transistor having an output circuit and a control electrode for varying the conductivity of said output circuit in dependence on a potential applied to the control electrode; said output voltage detecting element of each of the voltage stabilizing circuits includes a second transistor having an output circuit for determining said potential applied to the control electrode of the respective first transistor in dependence on a potential applied to a control electrode of said second transistor; and said means forming a respective reference voltage in said third voltage stabilizing circuit includes voltage divider means applying to said control electrode of the respective second transistor a proportion of said output voltage of the third voltage stabilizing circuit, and a Zener diode interposed in said output circuit of the second transistor of said third voltage stabilizing circuit.

10. A power circuit according to claim 8; in which said first, second and third voltage stabilizing circuits have first, second and third output terminals, respectively; and in which said output voltages obtained at said first and third output terminals, respectively, are positive, and said output voltage obtained at said second output terminal is negative.

* * * * *